United States Patent [19]

Komperda

[11] 4,369,974

[45] Jan. 25, 1983

[54] GOLF CLUB FOR PUTTING

[76] Inventor: Joseph Komperda, 11118 Woodview Blvd., Parma Heights, Ohio 44130

[21] Appl. No.: 257,459

[22] Filed: Apr. 24, 1981

[51] Int. Cl.[3] ..... A63B 53/04; A63B 69/36

[52] U.S. Cl. ..... 273/164; 273/183 D; 273/171; 273/168; 273/DIG. 14

[58] Field of Search ..... 273/77 R, 162 R, 163 R, 273/164, 167–175, 183 D, 186 R, 193 R, 194 R, DIG. 14, 183 E, 171

[56] References Cited

U.S. PATENT DOCUMENTS

| | | | |
|---|---|---|---|
| 1,454,267 | 5/1923 | Challis et al. | 273/164 X |
| 3,043,596 | 7/1962 | Ehmke | 273/163 R |
| 3,085,804 | 4/1963 | Pieper | 273/168 |
| 3,873,094 | 3/1975 | Sebo et al. | 273/163 R |
| 3,876,211 | 4/1975 | Caligiuri | 273/183 D |
| 3,880,430 | 4/1975 | McCabe | 273/164 X |
| 4,032,156 | 6/1977 | Clarke | 273/164 |

FOREIGN PATENT DOCUMENTS

| | | | |
|---|---|---|---|
| 8336 | of 1906 | United Kingdom | 273/168 |

*Primary Examiner*—George J. Marlo

[57] ABSTRACT

A golf club putter of the type having a golf shaft extending upward from the putter head comprising a translucent or transparent see-through solid putter head having peripheral outer vertical surfaces consisting of a forward putting face squared with a pair of spaced parallel side surfaces and opposite a rear surface. The forward and rearward vertical surfaces are opacified surfaces or all four vertical surfaces can be opacified. The vertical opacified surfaces are visible to a golfer looking downward at the putter head prior to putting and conveys information to the golfer of the extent of misalignment of the face of the putter with the golfball and the cup and degree of squaring with a centerline through the cup, the golfball, and the putter face.

2 Claims, 13 Drawing Figures

GOLF CLUB FOR PUTTING

This invention pertains to golf club putters and more particularly to a translucent putter head having visual alignment means for properly aligning the face of the putter head with a golf ball and the cup disposed in the putting green.

Golf club putters are ordinarily designed to assist the golfer in aligning the club head putting face with the cup by providing an uninterrupted view of the golf ball in alignment with the cup during the putting stroke. Putting ordinarily requires the golfer to stand with his eyes over the ball and the line of travel before moving the putter club head to cause the face of the same to impact the ball resting on the putting green. A particularly difficult problem encountered with conventional putters is the proper alignment of the putting face with the ball and cup wherein the putter blade face is ideally aligned at right angles to the line of putt. Any slight rotation of the shaft left or right relative to the desired right angle with the putting lines causes a much larger misdirection of the putt.

It now has been found that a golf club putter equipped with a clear translucent putter head formed in substantially a parallelogram shaped block having opacified vertical peripheral surfaces provides excellent visual alignment means for maintaining the putter face essentially perpendicular with the intended line of putting. The plurality of opacified vertical surfaces are either not visible or minimally visible to the golfer when the putter head face is properly aligned with the cup and the centerline from the cup through the ball bisects the putting head face. If any more than minimal visual appearance of the opacified peripheral vertical surfaces directly or indirectly through the translucent club head is observed, the golfer is informed thereby that the putter head is misaligned with the cup and the intended direction and line of putt.

Briefly, the invention is directed to a golf club putter head comprising a translucent or transparent see-through block-shaped putting head in the form of right rectangular prism having a plurality of vertically disposed opacified surfaces, including a putting face surface, adapted to provide visual alignment means for the golfer while putting. The vertically disposed opacified surfaces are either not perceived or only slightly perceived by the golfer when the club face is properly aligned with the intended putting line but provide visual warning means to the golfer when the putting face is misaligned with the intended putting line and the cup. When the putting face is misaligned, the opacified vertical warning surfaces are visible to the golfer directly or indirectly through the translucent putter head, whereby the golfer can immediately properly realign the putter head before stroking his putt.

Accordingly, a major objective of this invention is to provide a putter head which can be visually aligned in square and concentric alignment with the cup as well as aligned with a common center line from the cup through the golf ball to the center of the putter head face.

A further object of the invention is to provide a putter head having visual alignment means readily ascertainable in use by the golfer when the golfer places his putter in position and enable the golfer to adjust his position if the putting face thereof is not in squared relationship to the ball and cup and the putter side vertical surfaces are not in parallel alignment with the outer periphery of the cylindrical cup and to ascertain when the face is in such proper alignment.

Still a further objective is to provide a simple putter head comprising but a few parts and adapted to easily and inexpensively assembled into a golf club putter. These and other objects and advantages will become more apparent from the drawings together with the detailed description of the invention.

Figure 1:
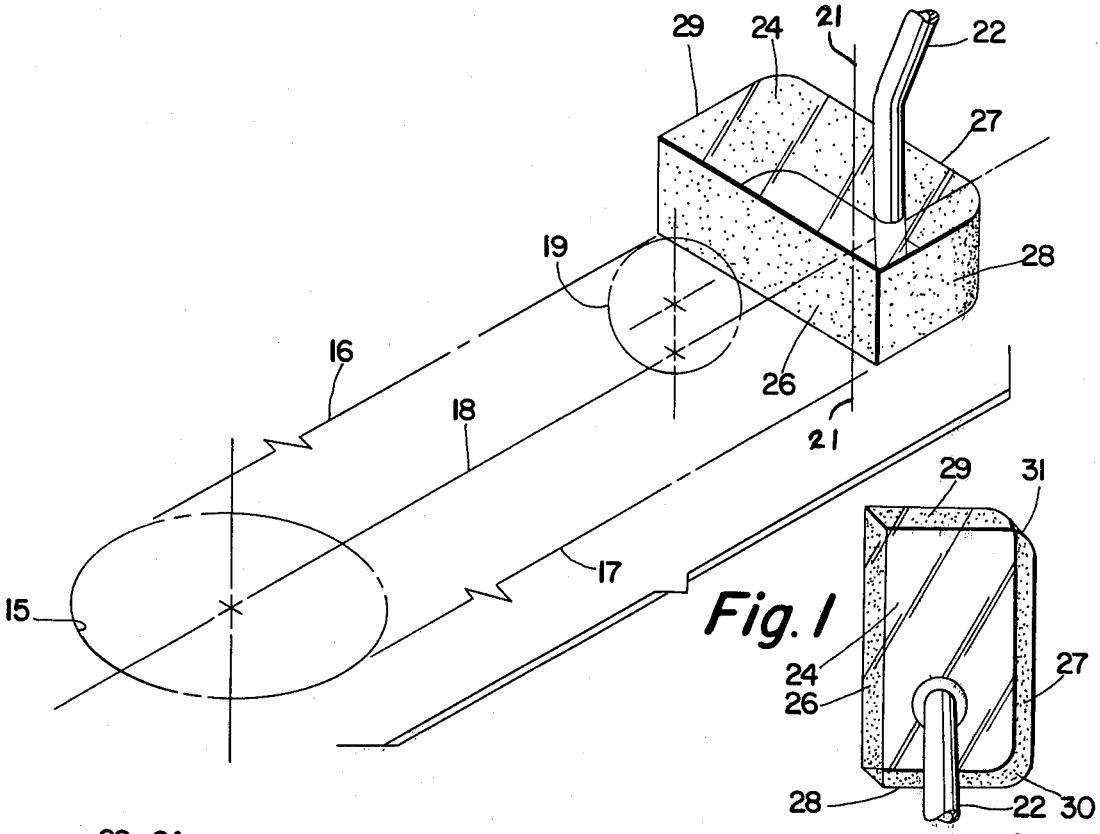
FIG. 1 is a perspective view of the golf club putter of the invention indicated in proper square alignment of the putter face relative to the cup.

Referring now to the drawings wherein like characters designate like parts, at 20 a golf club putter is shown comprising a golf shaft 22 and a translucent head 24 having a plurality of opacified vertical surfaces in accordance with this invention.

In FIG. 1, the putter head 24 is shown in square alignment with the putting hole or cup 15, the side surfaces 28 and 29 being in parallel relationship with the outer periphery of the cup 15 as indicated by parallel lines 16 and 17. A horizontal centerline 18 through the axial center of the cup 15 passes through the center of a golf ball 19 and bisects the face 26 of a putter head 24. A vertical viewing centerline 21 indicating the golfer's viewing line intersects the centroid of the putter head 24 as well as the horizontal centerline 18. The putter head 24 as shown comprises a translucent parallelogram shaped block having opacified outer peripheral vertical surfaces consisting of the putting face surface 26, a rearward surface 27, a side surface 28 nearest the golfer, and a far side surface 29 disposed away from the golfer and top and bottom substantially flat surfaces 33 and 34. The putter head preferably includes rounded rearward edges 30, 31 forming a radius with the rearward vertical surface 27 and each side vertical surface 28, 29, whereby the radial edges 30, 31 assist the golfer in aligning the putter head 24 with the rearward circumferential portions of the golf ball 19 as well as direct alignment with the rearward peripheral surfaces of the cup 15.

Figure 2:
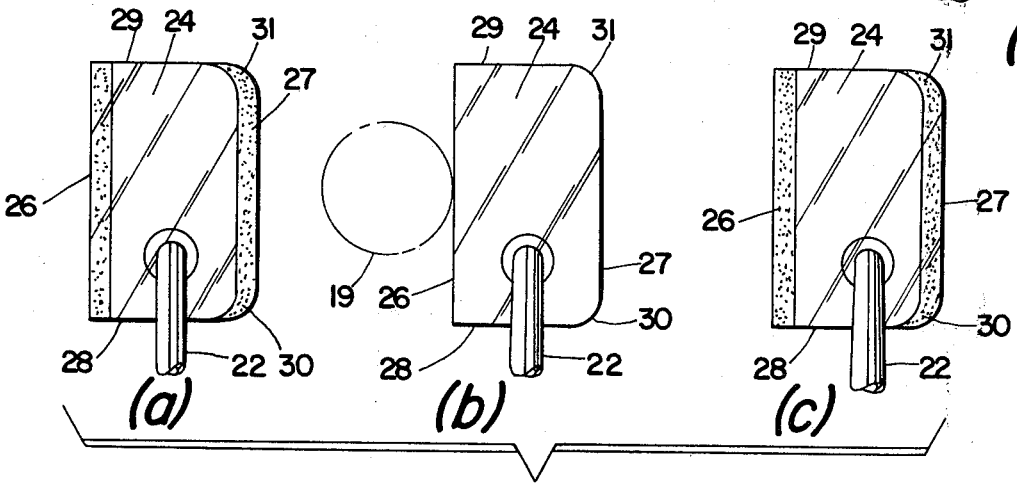
FIG. 2 is a plurality of perspective views of the golf club putter shown in FIG. 1 as viewed by a golfer in use wherein views (a), (c), and (d) are improper misalignments and (b) is proper alignment in accordance with the invention.

Referring now to FIG. 2, a putter 20 is shown in use and views (a), (c) and (d) illustrate visual misalignment of the putter head 24, whereas view (b) illustrates proper visual alignment during use as viewed by the golfer. In view (a), the opacified vertical putting surface 26 is misaligned by tilting the putter head 24 forward whereby the opacified putting surface 26 is readily visible through the transparent putting head 24 and the rearward opacified surface 27 is directly visible to the golfer. In view (c), the putter head 24 is misaligned and tilted backward whereby the opacified vertical putting surface 27 is exposed directly and the rearward opacified vertical surface 27 is exposed indirectly through the translucent putter head 24. In similar manner, view (d) shown improper alignment of the putter head 24 wherein the putter 20 is improperly tilted toward the golfer thereby exposing the putter head opacified far side surface 29 directly and exposing the opacified near surface 28 indirectly through the translucent putter head 24. Conversely, the opacified near surface 28 would be exposed directly and the opacified far surface 29 exposed indirectly through the translucent head 24 by improperly tilting the putter away from the golfer. In contrast to views (a), (c), (d), view (b) shows proper alignment of the putter head 24 in accordance with this invention wherein none of the opacified vertical surfaces 26, 27, 28 or 29 are visible to the golfer as viewed on the vertical viewing centerline 21.

Figure 3:
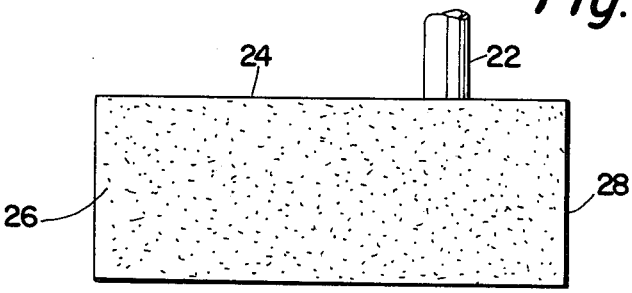
FIG. 3 is a front elevation view of the opacified vertical putting surface of the putter in FIG. 1.
Figure 4:
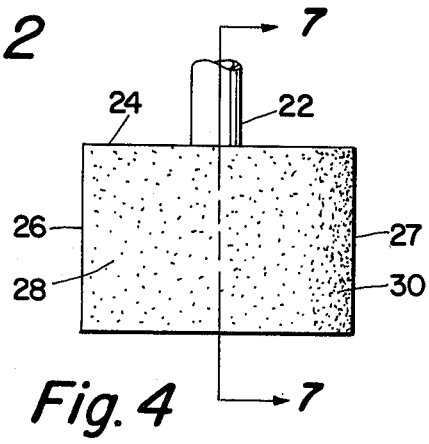
FIG. 4 is a side elevation view showing the opacified vertical side surface closest to the golfer of the putter shown in FIG. 1.
Figure 5:
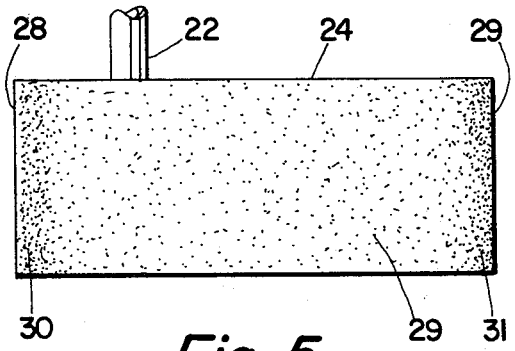
FIG. 5 is a back elevation view of the opacified rearward vertical surface of the putter shown in FIG. 1.
Figure 6:
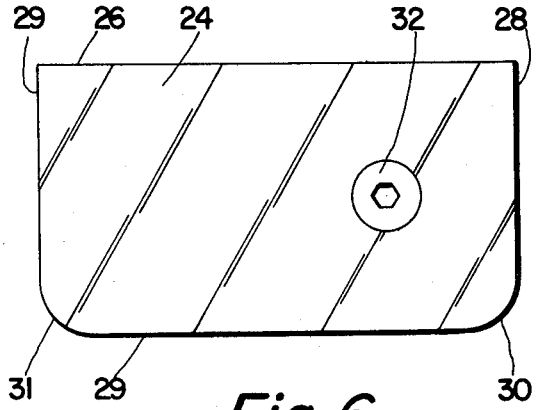
FIG. 6 is a top plan view of the translucent putter head with the golf shaft removed.

FIG. 3 shows the opacified vertical putting surface or face 26 which effectively blocks the translucency of the otherwise translucent putter head 24. FIG. 4 similarly shows the opacified vertical side surface 28 disposed nearest to the golfer, and FIG. 5 shows the opacified vertical side surface 29 disposed away from the golfer. FIG. 6 shows a top plan view of the translucent putter head 24 with the golf shaft 22 removed whereby the putter head 24 is essentially transparent from the top to bottom with none of the vertically disposed opacified surfaces 26, 27, 28, 29 being visible directly or indirectly through the translucent putter head 24 as viewed from a point on the vertical centerline 21.

Figure 7:
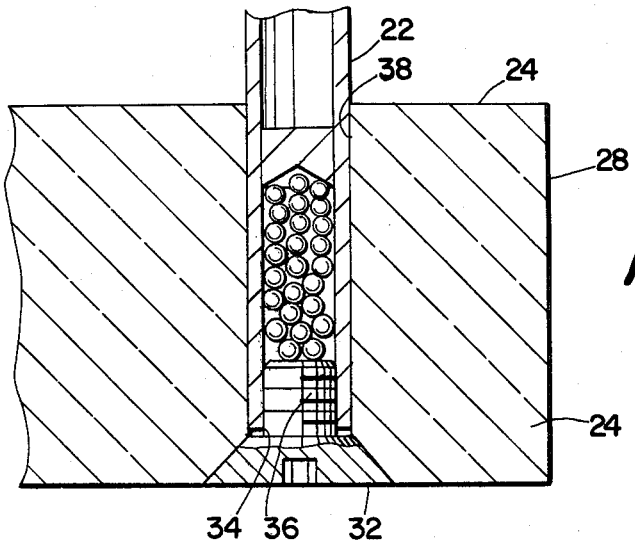
FIG. 7 is a partial section view taken along lines 7—7 in FIG. 4.
Figure 8:
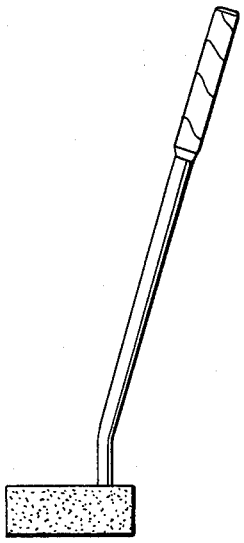
FIGS. 8, 9, and 10 show varied golf shafts attached to putting heads of the putter of my invention.
Figure 9:
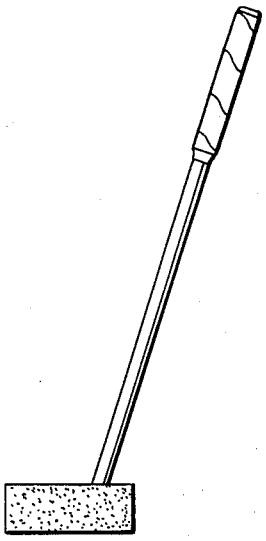
Figure 10:
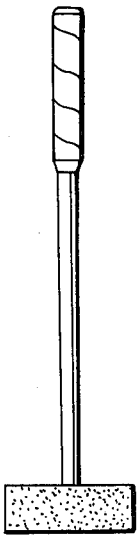

As best shown in FIG. 7, the shaft 22 is hollow and can be attached or detached from the translucent putter head 24 by means of a threaded connection comprising an inverted screw connector 32 imbedded within the putter head 24 from the bottom portion thereof whereby internal threads 34 of the hollow shaft 22 securely engage external threads 36 of the imbedded screw connector 32. Hence, the translucent putter head 24 contains an elongated hosel 38 adapted to receive the shaft 22 therein for connection with the imbedded connector 32. The hosel 30 and shaft 22 disposed therein can be disposed substantially vertically as shown in FIGS. 8 and 9 or can be disposed at an angle as shown in FIG. 9.

The translucent putter head 24 can be produced from cast or molded clear molding compositions such as lucite, polymethylmethacrylate, or polystyrene, or similar vinyl, acrylate or methacrylate type molding compositions capable of forming a translucent putter head 24. The putter head 24 material is rigid but with some resiliency to provide proper impact upon stroking the ball while putting. The opacified surfaces can be opacified coatings applied to the surfaces or opacified film secured to the surfaces. Opacification can be produced by etching by corrosive gas, such as flourine or by mechanical or chemical means. The putter head 24 can be produced by molding a solid translucent block in the desired configuration of substantially a parallelogram block with vertical peripheral surfaces comprising a parallelogram block with vertical peripheral surfaces comprising a putting surface, a rearward surface, a near side surface, and a far side surface. The top and bottom surfaces of the putter head 24 are preferably flat. The vertical surfaces are rendered opacified whereas the top and bottom surfaces are maintained clear to preserve translucency through the putter head 24 from top to bottom. The hosel 30 for receiving the golf shaft 22 can be molded directly in the block or subsequently drilled, provided the inverted screw connector is secured in tight engagement within the translucent putter head 24. The screw connector 32 likewise can be molded directly into the putter head 24 or added subsequently. The hollow shaft 22 can then be connected to the putter head 24 with metal shot 38' added if desired to provide weight and a properly balanced putter 20.

In use, the translucent see-through putter head 24 with opacified vertical surfaces provides easy visual alignment for squareness and alignment with the horizontal centerline 18. Proper putting technique consists of the golfer locating his eyes on the vertical viewing centerline 21 and projecting the line of travel of the ball 19 to the cup 15, which for normal putting green surfaces is the horizontal centerline 18. Visual alignment further includes parallel alignment of the putter head 24 side opacified surfaces 27, 28 with the outer periphery of the cup 15 as indicated by imaginary parallel lines 16 and 17. When the putting green surface is uneven, the alignment is adjusted accordingly to either side of the cup to accomodate the putting green characteristics. However, the putting head 24 is nevertheless maintained square whereby none of the opacified surfaces are visible to the golfer's eye. Thus, the golfer positions his eyes on vertical viewing centerline 21 and over the ball and adjusts the putter head 24 in alignment with the intended line of travel which usually is the horizontal centerline 18. The golfer forms a rectangular visual profile looking downwardly on the parallelogram configuration of the translucent putter head 24, whereby the golfer assures himself that the putter head 24 is properly aligned by adjusting the putter head 24 until none of the vertical opacified surfaces are visible directly or indirectly through the translucent putter head 24. If the front, rear, or either side opacified surface is visible the golfer adjusts the putter head 24 accordingly to eliminate visibility or minimal visibility of any of the opacified vertical surfaces, whereupon the squareness alignment of the putter head 24 to the cup 15 is again rechecked.

The foregoing illustrates preferred embodiments of the invention but is not intended to be limiting except by the appended claims.

I claim:

1. A golf club putter comprising a putter head and an upwardly extending shaft secured to the putter head, comprising:

said putter head being a translucent solid parallelogram shaped block having vertically disposed outer surfaces consisting of a front putting surface, a parallel rearward surface, and two intervening side surfaces disposed between said forward and said rearward surfaces, said outer surfaces being opacified surfaces adapted to provide visible alignment means for squaring alignment of said putter head with said cup wherein said opacified surfaces are not visible from a viewing point on a viewing line perpendicular to said putter head and intersecting the centroid of said putter head.

2. A method of aligning a golf putter head of a golf club putter, wherein said putter head is a translucent solid having substantially vertical sides consisting of forward putting surface, two side surfaces, and a rearward surface, said vertical surfaces being opacified surfaces for visually aligning the putting surface with the cup, the method comprising:

squaring the front putting face surface of the putting head with the cup in a manner wherein the putting face is essentially perpendicular with a centerline bisecting the cup, the golf ball, and the putting face; and maintaining said putting face in a squared position while aligning the putter head so that said opacified surfaces are no longer substantially visible from a viewing point disposed on a viewing line coinciding with the centroid of the putter head.

* * * * *